US008144883B2

(12) United States Patent
Pedersen

(10) Patent No.: US 8,144,883 B2
(45) Date of Patent: Mar. 27, 2012

(54) METHOD AND SYSTEM FOR ADAPTING A LOUDSPEAKER TO A LISTENING POSITION IN A ROOM

(75) Inventor: Jan Abildgaard Pedersen, Holstebro (DK)

(73) Assignee: Bang & Olufsen A/S, Struer (DK)

( * ) Notice: Subject to any disclaimer, the term of this patent is extended or adjusted under 35 U.S.C. 154(b) by 1374 days.

(21) Appl. No.: 11/568,721

(22) PCT Filed: Apr. 27, 2005

(86) PCT No.: PCT/IB2005/051369
§ 371 (c)(1),
(2), (4) Date: Nov. 6, 2006

(87) PCT Pub. No.: WO2005/109954
PCT Pub. Date: Nov. 17, 2005

(65) Prior Publication Data

US 2008/0008329 A1 Jan. 10, 2008

(30) Foreign Application Priority Data

May 6, 2004 (DK) ..... 2004 00732

(51) Int. Cl.
*H04R 29/00* (2006.01)

(52) U.S. Cl. ..... 381/59; 381/58; 381/96; 381/103; 381/303

(58) Field of Classification Search ..... 381/56, 381/96, 103, 303, 58–59
See application file for complete search history.

(56) References Cited

U.S. PATENT DOCUMENTS

| | | | | |
|---|---|---|---|---|
| 5,682,433 | A | 10/1997 | Pickard et al. | |
| 5,910,990 | A | 6/1999 | Jang | |
| 7,092,535 | B1 * | 8/2006 | Pedersen et al. | 381/96 |
| 7,526,093 | B2 * | 4/2009 | Devantier et al. | 381/59 |
| 7,697,701 | B2 * | 4/2010 | Pedersen et al. | 381/96 |
| 7,742,607 | B2 * | 6/2010 | Karjalainen et al. | 381/66 |
| 2002/0114483 | A1 * | 8/2002 | Azima et al. | 381/345 |
| 2002/0154785 | A1 * | 10/2002 | Pedersen | 381/59 |
| 2003/0235318 | A1 | 12/2003 | Bharitkar et al. | |
| 2005/0031143 | A1 * | 2/2005 | Devantier et al. | 381/300 |

FOREIGN PATENT DOCUMENTS

| | | |
|---|---|---|
| EP | 0 772 374 | 5/1997 |
| JP | 2001-346299 | 12/2001 |

OTHER PUBLICATIONS

Bharitkar S et al: "A cluster centroid method for room response equalization at multiple locations", Applications of Signal Processing to Audio and Acoustics, 2001, IEEE Workshop on the, Oct. 21-24, 2001, Piscataway, NJ, USA, IEEE, pp. 55-58, XP010566873, ISNB: 0-7803-7126-7.

* cited by examiner

*Primary Examiner* — Devona Faulk
*Assistant Examiner* — Disler Paul
(74) *Attorney, Agent, or Firm* — Stites & Harbison PLLC; Marvin Petry

(57) ABSTRACT

The invention relates to a method and a system for adapting a loudspeaker to a specific listening position relative to the loudspeaker according to which method and system the acoustic power radiated by the loudspeaker is corrected by means of a correction filter inserted in the signal path through the loudspeaker, the response of said correction filter being determined by comparison between the a quantity characterising the radiated acoustic power measured at an actual listening position and a similar quantity measured at a reference listening position. According to a specific embodiment of the invention said characterising quantities are the radiation resistances measured at the actual listening position and the reference listening position respectively.

10 Claims, 3 Drawing Sheets

METHOD AND SYSTEM FOR ADAPTING A LOUDSPEAKER TO A LISTENING POSITION IN A ROOM

TECHNICAL FIELD

The present invention relates to loudspeakers for high-fidelity sound reproduction and particularly to loudspeakers whose frequency response can be adapted to the particular listening position in a room.

BACKGROUND OF THE INVENTION

Loudspeakers with a frequency response that can be adjusted to specific requirements of a listener are known within the art. Traditionally adaptation has taken place by the measurement of the sound pressure level at the particular listening position, i.e. a suitable measuring microphone is placed at the position which is to be occupied by the head of the listener and the frequency response of the loudspeaker is measured at this position. The frequency response at this position is the resulting frequency response of the loudspeaker itself (as measured in an anechoic chamber) and the acoustic effect of the particular listening room. Even if the frequency response of the loudspeaker itself is very uniform over frequency, the acoustical characteristics of the room, i.e. reflections from the boundaries of the room and from various objects located in the room, can result in a very non-uniform frequency response at the listening position, a frequency response which moreover may depend very much on the exact measuring position. Thus, corrections of the free field frequency response of the loudspeaker itself based on such measurements are not satisfactory.

Basically there are two aspects of adapting the acoustical response of a loudspeaker to a given room, which result from the following two problems:

(1) The loudspeaker's ability to provide acoustic power to the room depends on the location of the loudspeaker in the room, i.e. its position relative to the boundaries of the room. Thus, for instance when a loudspeaker is moved towards a corner position in a room, the low frequency response of the loudspeaker increases, which may lead to an undesirable "boomy" bass reproduction.

(2) Even though the ability of the loudspeaker to provide acoustic power to the room may be made practically independent on frequency (or have a particularly desirable frequency dependency), the frequency response of the loudspeaker measured at a particular listening position in the room may exhibit quite large deviations from the target response due to the influence of room acoustics on the transfer function of the loudspeaker from the position of the loudspeaker to the actual listening position. It is not possible to compensate for these deviations without knowledge of the actual sound field generated by the loudspeaker at the particular listening position.

The first of the above aspects has been dealt with extensively in EP-0,772,374 and EP-1,133,896. In such systems, a digital correction filter is inserted into the signal chain. The correction filter in such systems is based on two measurements of the radiation resistance. First the radiation resistance is measured in a reference loudspeaker position in a reference room. Then the measurement is repeated in the actual loudspeaker position in the actual room, e.g. in the living room belonging to the user of the loudspeaker. (Measurements could alternatively also be performed at two different positions in the listening room, the actual position for some reason giving rise to undesirable acoustical effects and the reference position being regarded as acoustically more satisfactory).

The relationship between these two measured radiation resistances then determines the characteristics of the correction filter in such a way that the perceived timbre using the actual loudspeaker position in the actual room resembles to a large extent the perceived timbre using the reference loudspeaker position in the reference room or the more satisfactory position in the actual listening room.

The above system thus adapts the loudspeaker to the actual listening room as such, but it does not compensate for the above-mentioned deviations of the frequency response from a given target at a particular listening position in the actual listening room.

SUMMARY OF THE INVENTION

According to the present invention, the above problem is solved by utilising a measurement of the acoustic radiation resistance at the actual listening position and a corresponding measurement at a chosen reference listening position and based on these measurements designing a compensating filter to be inserted in the signal path through the loudspeaker. Both of these measurements can be performed by the loudspeaker whose acoustical characteristics are to be adapted to the listening room, i.e. the loudspeaker which is used for sound reproduction by simply moving it to the listening position while performing the measurement there (correction for listening position) and then returning it to the loudspeaker position for measurement there (correction for loudspeaker placement in the listening room) and finally for playback of music. It should, however, be noted that it is not necessary to use the same loudspeaker for the measurements at the listening positions and the loudspeaker position. A special/separate "measurement loudspeaker" can be used for the measurement at the listening positions—or even both at listening positions and loudspeaker positions. Although use of a separate loudspeaker for the measurements at the listening positions may seem undesirable as this loudspeaker will not form part of the reproduction system, it must be born in mind that the loudspeaker actually used for sound reproduction may be quite large and heavy and in fact difficult to place at the listening positions.

According to a preferred embodiment of the present invention, a total correction filter—correcting both for an undesirable placement of the loudspeaker in the room (as described in EP-0,772,374 and EP-1,133,896) and for undesirable acoustic effects at the actual listening position—can be determined based on measurements of radiation resistance at two loudspeaker positions and on measurements of radiation resistance at two listening positions. The transfer function of this correction filter is given in the detailed description of the invention and can be expressed as:

$$\mathrm{Amp}(f)=\mathrm{LS}(f)\cdot\mathrm{LISTENER}(f)$$

where LS(f) is the correction filter related to the placement of the loudspeaker in the room and LISTENER (f) is the correction filter related to the listening position in the room.

According to another embodiment of the invention it would also be possible solely to apply correction for an undesirable listening position, in which case the transfer function of the correction filter would reduce to:

$$\mathrm{Amp}(f)=\mathrm{LISTENER}(f)$$

It should furthermore be noted that just like in the above-mentioned patents EP0772374 and EP1133896, radiation resistance could be replaced by other acoustic parameters, which are analogue to radiation resistance, e.g. active acoustic power output or acoustic wave resistance.

Radiation resistance in free field is one possible value for the reference radiation resistance for both listening position and loudspeaker position, e.g. a function of f squared, where f is the frequency.

BRIEF DESCRIPTION OF THE FIGURES

The invention will be more fully understood with reference to the figures and with reference to the following detailed description of an embodiment of the invention. Thus, the figures show.

DETAILED DESCRIPTION OF THE INVENTION

In the adaptive bass control system described in the above-mentioned patents EP0772374 and EP1133896, a digital correction filter is inserted into the signal path through the loudspeaker. Equation (1) gives the amplitude target for such a correction filter, LS(f). LS indicates that this filter is based on measurements of radiation resistance in two loudspeaker positions.

$$LS(f) = \sqrt{\frac{R_{m,r,reference\ loudspeaker\ position}(f)}{R_{m,r,actual\ loudspeaker\ position}(f)}} \tag{1}$$

Figure 1:
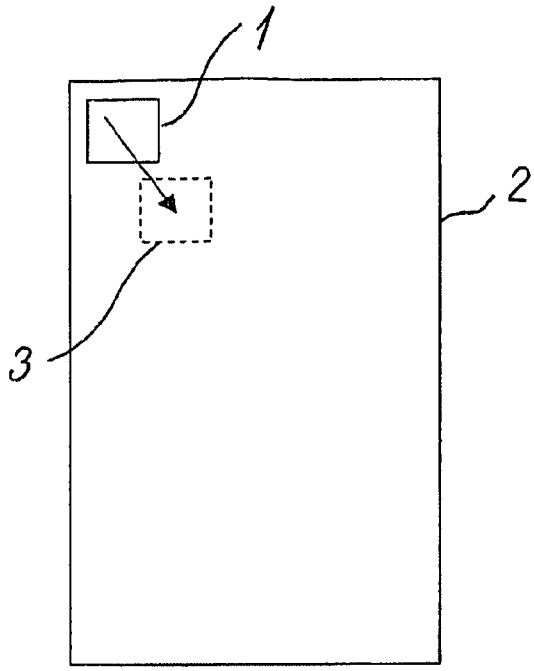
FIG. 1. Example of a correction of the response of a loudspeaker which is placed at a non-ideal position in a room.
Figure 2:
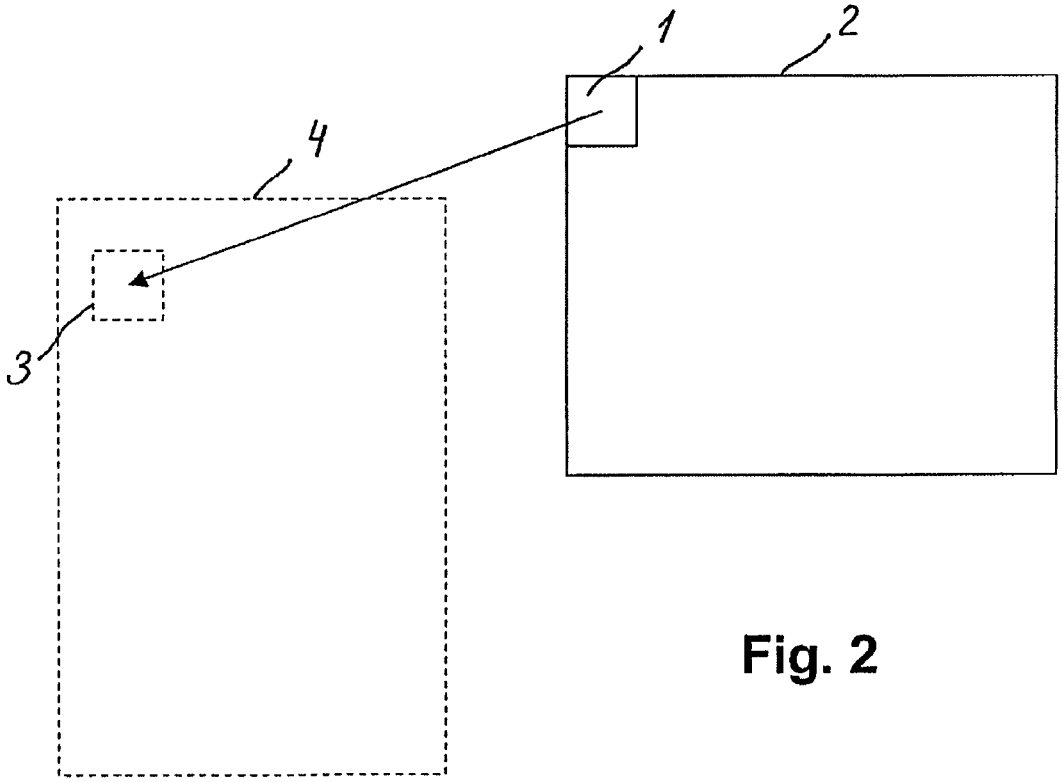
FIG. 2. Example of a correction of the response of a loudspeaker which is placed at a non-ideal position in a non-ideal listening room.

The perceived effect of the above correction is schematically illustrated in FIGS. 1 and 2. Thus in FIG. 1 an actual listening room is indicated by reference numeral 2, and the actual loudspeaker position is indicated by 1. If the actual loudspeaker position gives rise to undesirable acoustic effects due to the placement of the loudspeaker in the room (in the illustrated case in a corner position of the room), it is possible to compensate for these effects by means of a filter with the transfer function determined by equation (1). Thus, the overall timbre of the sound reproduced by the loudspeaker will despite the corner placement 1 correspond to the more desirable reference loudspeaker position indicated by 3. The effect of the correction is symbolised by the arrow.

Another possible adaptation of a loudspeaker to a given room based on the above correction filter according to the above-mentioned patents EP0772374 and EP1133896 is shown in FIG. 2. In this figure, the broken line 4 indicates an ideal listening room in which a loudspeaker is positioned at a given desirable position 3 relative to the boundaries of the room. In an actual listening room 2, which may not be ideal for loudspeaker reproduction, a loudspeaker 1 is located, for instance as shown in a corner position, which may in itself be acoustically problematic. As described in the above-mentioned patents it is possible by means of the above correction filter to compensate for the acoustic effects of the non-ideal listening room and the non-ideal loudspeaker position so that the timbre of the reproduced sound will correspond to the more ideal situation indicated by broken lines.

Figure 3:
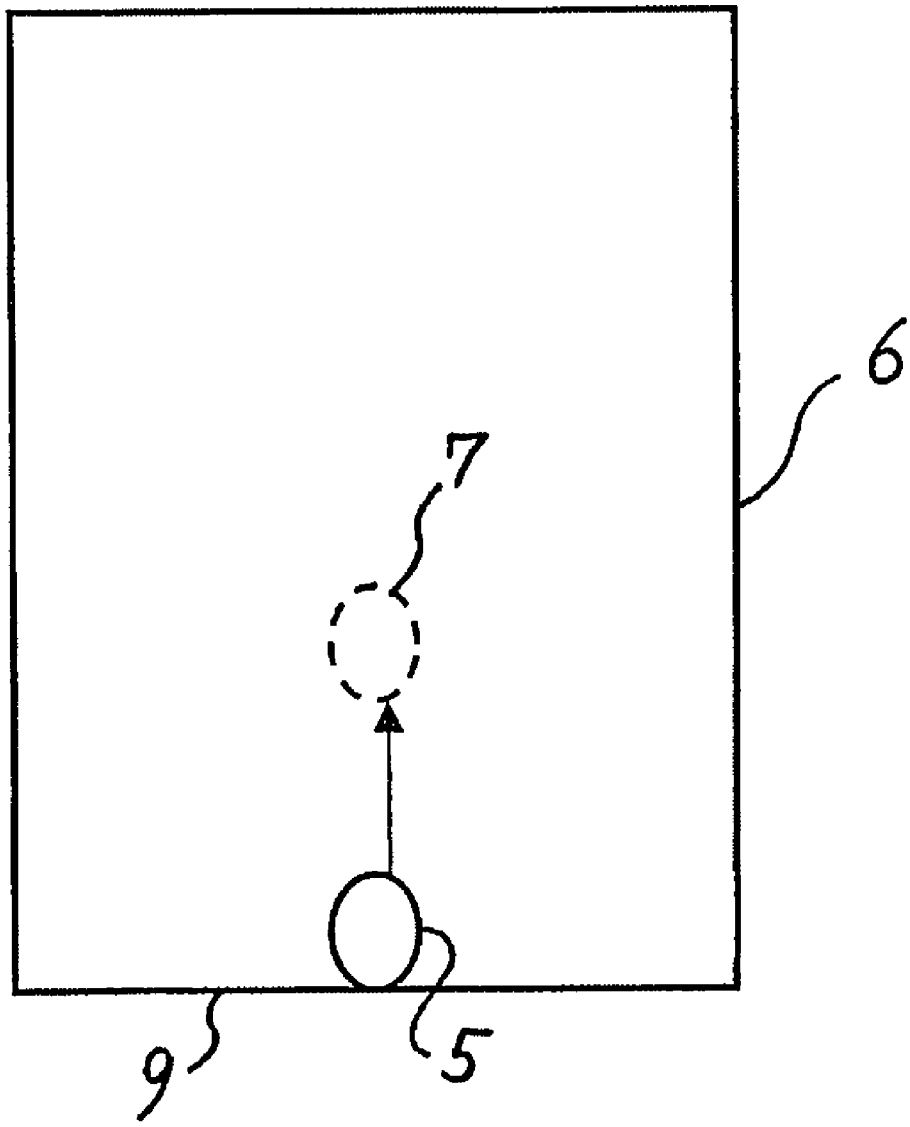
FIG. 3. Example of a correction of the response of a loudspeaker to compensate for a non-ideal listening position.

Embodiments of the present invention are illustrated with reference to FIGS. 3 and 4. Thus, according to an embodiment of the present invention as illustrated in FIG. 3, an actual listening position 5, which is acoustically problematic due to its proximity to the rear wall 9 of an actual listening room 6, is compensated for based on measurements of the radiation resistance in the actual listening position 5 and in a reference listening position (a preferred or ideal listening position) 7. As mentioned previously these measurements can be carried out using the same loudspeaker as is actually used for sound reproduction, although it would also be possible to use a dedicated measurement loudspeaker, which for instance could be more easy to move around a room and place at a given listening position. Based on measurements of the radiation resistance at the actual listening position 5 and at the reference listening position 7, there is according to the invention defined a second correction filter, the transfer function of which is given by equation (2), where LISTENER indicates that this filter is based on measurements of radiation resistance in two listening positions.

$$\text{LISTENER}(f) = \sqrt{\frac{R_{m,r,reference\ listening\ position}(f)}{R_{m,r,actual\ listener\ position}(f)}} \tag{2}$$

Thus, the actual, problematic listening position 5 is compensated for according to the invention by carrying out measurements of the radiation resistance in the ideal listening position 7 and in the actual listening position 5 and afterwards processing the signal to the loudspeaker by means of a correction filter with a transfer function given by equation (2) above.

Apart from the above compensation for a non-ideal listening position, the total effect of a non-ideal listening position, a non-ideal loudspeaker position and a non-ideal listening room can according to the invention be compensated for by means of a correction filter with a transfer function Amp(f) given by equation (3) below. Thus, the total amplitude target response for a correction filter according to this embodiment of the invention, Amp(f), can then be calculated using equation 3, which is simply a multiplication of equation 1 and 2.

$$\text{Amp}(f) = LS(f)\cdot\text{LISTENER}(f) = \sqrt{\frac{R_{m,r,reference\ loudspeaker\ position}(f)\cdot R_{m,r,reference\ listening\ position}(f)}{R_{m,r,actual\ loudspeaker\ position}(f)\cdot R_{m,r,actual\ listening\ position}(f)}} \tag{3}$$

Thus, the correction filter according to equation 1 compensates the coupling between the sound source (loudspeaker) and the sound field generated in the listening room, and/or a non-ideal listening room compared to an ideal or reference listening room and the correction filter according to equation 2 compensates for the coupling between the sound field and the receiver (listener). In this way both room acoustics, loudspeaker position and listening position are compensated.

Figure 4:
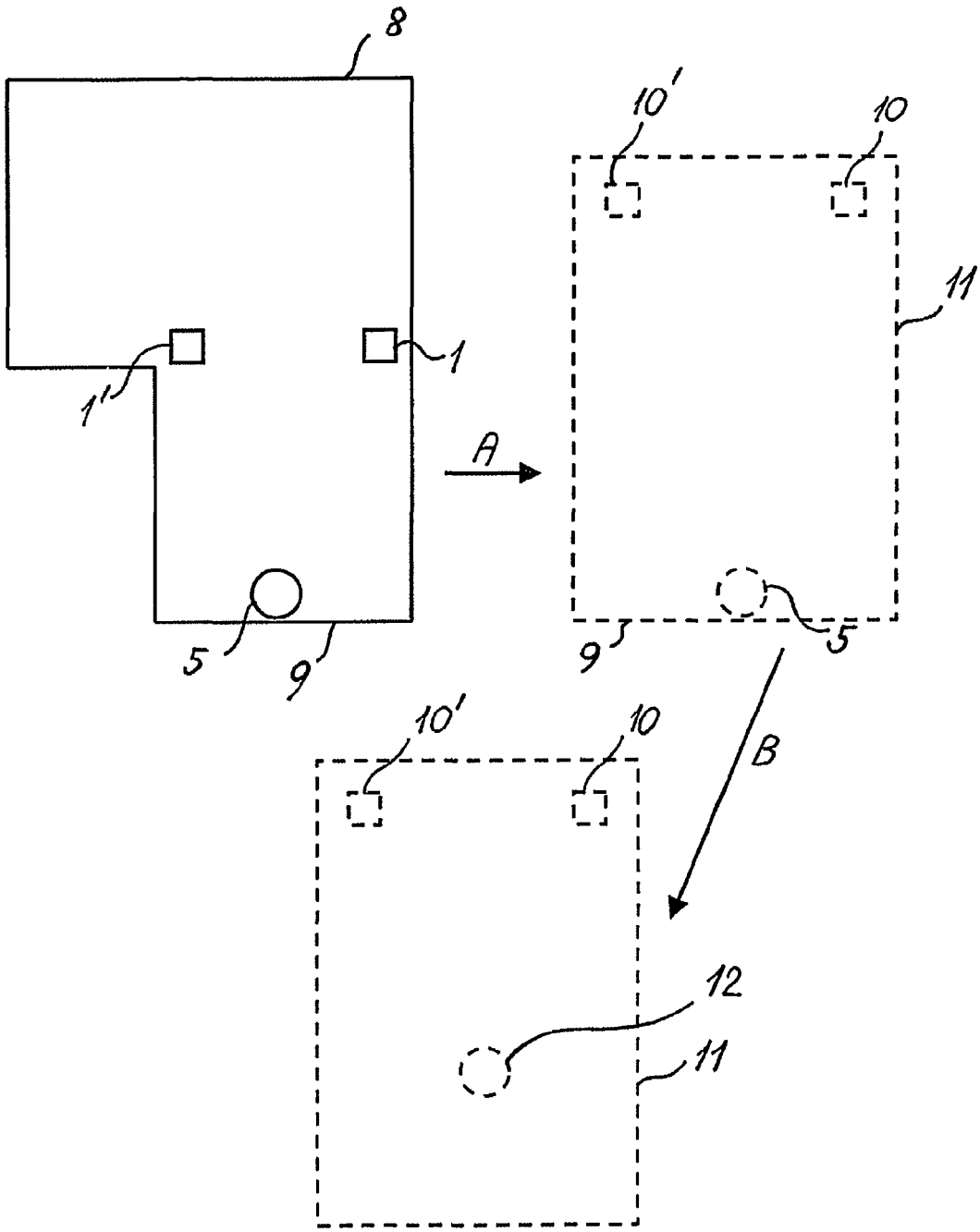
FIG. 4. Example of a correction of the response of a loudspeaker to compensate for a non-ideal listening position in a non-ideal listening room.

With reference to FIG. 4 there is shown a schematic illustration of a situation where the method and system according to the invention is utilised to compensate both for a non-ideal listening room 8 and a non-ideal position of a loudspeaker 1' in this room and a non-ideal listening position 5 in the room. Thus, the application of a correction filter according to equation (1) compensates for the non-ideal position of loudspeaker 1' in the non-ideal listening room 8 as schematically indicated by arrow A, thus making the timbre of the loudspeaker 1' correspond to the timbre of a loudspeaker 10' ideally positioned in the ideal listening room 11. A further application of a correction filter according to equation (2) compensates for the non-ideal listening position 5 at the rear wall 9 making the timbre of the loudspeaker more nearly corresponding to the listening position 12 at a distance from the rear wall 9. This effect is schematically indicated by arrow B in FIG. 4. The overall effect of the application of the two correction filters is given by equation (3).

It should be noted that although reference values of radiation resistance are described above as being actually measured during the correction processes described, it would also be possible to replace these measured radiation resistances by radiation resistances which parameters a priory (for instance based on experience) are regarded as desirable. Thus, radiation resistance in the free field would be one possible value for the reference radiation resistance for both listening position and loudspeaker position, e.g. a function of f squared, where f is the frequency.

In practice it would of course be possible to store a number of different reference radiation resistances and choose among these as desired.

Although the present invention has been described in detail based on measured or predetermined radiation resistances, it is understood that the radiation resistance can be replaced by other acoustic parameters, which are analogue to the radiation resistance, e.g. active acoustic power output or acoustic wave resistance.

The invention claimed is:

1. A method for adapting a loudspeaker to a specific listening position relative to the loudspeaker by correcting acoustic power radiated by the loudspeaker by means of a correction filter inserted in the signal path through the loudspeaker, the method comprising:

(i) measuring, at an actual listening position, a first quantity characterising the acoustic power radiated by the loudspeaker;

(ii) measuring, at a reference listening position, a second quantity characterising the acoustic power radiated by the loudspeaker;

(iii) using an electronic comparison means to determine a response of a correction filter by a comparison between said first quantity and said second quantity;

(iv) implementing said correction filter; and (v) inserting said correction filter in the signal path through the loudspeaker, and wherein said first and second characterising quantities are radiation resistances measured at the actual listening position and the reference listening position, respectively.

2. The method according to claim 1 where the frequency response of said correction filter is given by $$\text{LISTENER}(f) = \sqrt{\frac{R_{m,r,reference\ listening\ position}(f)}{R_{m,r,actual\ listener\ position}(f)}}$$

where $R_{m,r,reference\ listening\ position}$ is the radiation resistance at the reference listening position as a function of frequency, and $R_{m,r,actual\ listening\ position}$ is the radiation resistance at the actual listening position as a function of frequency.

3. The method according to claim 2 comprising a further adaptation of the loudspeaker to the actual position in the listening room in which the loudspeaker is placed by means of a correction filter, the frequency response (Amp(f)) of which is given by $$Amp(f) = \sqrt{\frac{R_{m,r,reference\ loudspeaker\ position}(f) \cdot R_{m,r,reference\ listening\ position}(f)}{R_{m,r,actual\ loudspeaker\ position}(f) \cdot R_{m,r,actual\ listening\ position}(f)}}$$

4. The method according to claim 3, where the radiation resistances at the actual listening position and reference listening position are measured by means of the loudspeaker adapted to the actual position in the listening room.

5. The method according to claim 3, where the radiation resistances at the actual listening position and reference listening position are measured by a dedicated sound source.

6. The method according to claim 1, wherein the radiation resistances measured at said reference loudspeaker and measured at the listening positions are replaced by predetermined radiation resistances.

7. The method according to claim 6, where said predetermined radiation resistances are the free field radiation resistances being a function of $f^2$.

8. A system for adapting a loudspeaker to a specific listening position in a room relative to the loudspeaker by correcting acoustic power radiated by the loudspeaker by means of a correction filter inserted in the signal path through the loudspeaker, said system comprising a processing unit means that determines a response of a correction filter by a comparison between said a first quantity measured at an actual listening position that characterizes the acoustic power radiated by the loudspeaker and a second quantity measured at a reference listening position that characterizes the acoustic power radiated by the loudspeaker; and filter means for implementing said correction filter based on transfer functions LS(f) and LISTENER(f), where $$LS(f) = \sqrt{\frac{R_{m,r,reference\ loudspeaker\ position}(f)}{R_{m,r,actual\ loudspeaker\ position}(f)}},$$

and $$\text{LISTENER}(f) = \sqrt{\frac{R_{m,r,reference\ listening\ position}(f)}{R_{m,r,actual\ listener\ position}(f)}}.$$

9. A system according to claim 8, said system furthermore comprising means for storing either predetermined radiation resistances or measured radiation resistances.

10. A system according to claim 8 furthermore comprising a dedicated sound source for carrying out measurements of radiation resistance at the actual listening position and at the reference listening position.

* * * * *